US007503384B2

(12) United States Patent
Coronado

(10) Patent No.: US 7,503,384 B2
(45) Date of Patent: Mar. 17, 2009

(54) MULTIPLE PORT CROSS-OVER DESIGN FOR FRAC-PACK EROSION MITIGATION

(75) Inventor: Martin P. Coronado, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 264 days.

(21) Appl. No.: 11/065,741

(22) Filed: Feb. 25, 2005

(65) Prior Publication Data

US 2006/0191685 A1 Aug. 31, 2006

(51) Int. Cl.
*E21B 43/04* (2006.01)

(52) U.S. Cl. ..... 166/51; 166/222

(58) Field of Classification Search ..... 166/278, 166/51, 222; 175/424
See application file for complete search history.

(56) References Cited

U.S. PATENT DOCUMENTS

| | | | | | |
|---|---|---|---|---|---|
| 5,443,117 | A * | 8/1995 | Ross | 166/51 |
| 5,577,559 | A | 11/1996 | Voll et al. | 166/278 |
| 5,597,040 | A * | 1/1997 | Stout et al. | 166/51 |
| 5,636,691 | A * | 6/1997 | Hendrickson et al. | 166/278 |
| 5,823,254 | A | 10/1998 | Dobson et al. | 166/51 |
| 5,964,287 | A * | 10/1999 | Brooks | 166/117.6 |
| 5,964,296 | A * | 10/1999 | Ross | 166/373 |
| 6,491,097 | B1 * | 12/2002 | Oneal et al. | 166/278 |
| 6,581,702 | B2 * | 6/2003 | Dickey | 175/340 |
| 6,702,020 | B2 | 3/2004 | Zachman et al. | 166/278 |
| 7,096,946 | B2 * | 8/2006 | Jasser et al. | 166/278 |
| 2003/0000702 | A1 | 1/2003 | Streich et al. | 166/278 |
| 2005/0269076 | A1 * | 12/2005 | Russell | 166/242.4 |
| 2006/0070740 | A1 * | 4/2006 | Surjaatmadja et al. | 166/308.1 |

FOREIGN PATENT DOCUMENTS

| | | | |
|---|---|---|---|
| EP | 1132571 | A | 9/2001 |
| GB | 2376493 | A | 12/2002 |
| WO | WO 2004/001179 | A2 | 12/2003 |

* cited by examiner

*Primary Examiner*—David J Bagnell
*Assistant Examiner*—Robert E Fuller
(74) *Attorney, Agent, or Firm*—Shawn Hunter

(57) ABSTRACT

A system for use in gravel packing operations wherein a gravel placement mandrel defines an axial flowbore and two or more lateral slurry flow ports for communication of slurry from the flowbore to the interior of the wear sleeve/blast liner. The slurry flow ports are oriented so as to distribute the slurry in different outwardly radial directions. The slurry flow ports are also axially displaced from one another along the gravel placement mandrel body. Relatively equivalent flow rates or flow amounts are provided through each of the slurry flow ports. Improvements are also provided in the geometry of the slurry flow ports to enhance the flow of slurry through them.

12 Claims, 4 Drawing Sheets

MULTIPLE PORT CROSS-OVER DESIGN FOR FRAC-PACK EROSION MITIGATION

BACKGROUND OF THE INVENTION

1. Field of the Invention

The invention relates generally to devices and methods for improved gravel packing operations within a wellbore. In more particular aspects, the invention relates to the design of devices that are used to place gravel or other solids in such operations.

2. Description of the Related Art

During gravel packing, a slurry containing gravel or a proppant is pumped down a tubing string into a wellbore and placed where desired using a cross-over tool with suitable exit ports for placement of the gravel in desired locations within the wellbore. A typical conventional gravel packing cross-over tool is described, for example, in U.S. Pat. No. 6,702,020, issued to Zachman et al. This patent is owned by the assignee of the present invention and is hereby incorporated by reference.

Gravel packing operations create significant erosion wear upon the components of the cross-over assembly as the gravel or proppant is flowed into the wellbore. One area that tends to receive the most severe damage is around the exit aperture where the solid material exits the crossover tool through a slurry flow port and enters the inside of the production assembly. In order to counter wear damage a wear sleeve, or blast liner, is typically placed around the crossover tool proximate the slurry flow port. A number of gravel exit ports are then circumferentially spaced around the lower end of the wear sleeve or blast liner to distribute the solid material into the entire surrounding annulus. However, the addition of a blast liner provides only a limited amount of protection for the device.

A problem that has been recognized by the inventor is that gravel packing systems of this type are limited in their ability to handle ultra high rate proppant slurry flows. Solid material exiting the slurry flow port of the cross-over tool tends to gather in the space between the outer surface of the cross-over tool and the inner surface of the wear sleeve on only one side of that space. As a result, the solid material is not evenly distributed when exiting the wear sleeve.

An additional problem with conventional gravel packing systems is the erosion of the wear sleeve or blast liner. Flow capacity for existing slurry flow ports has been exceeded by recent demands that systems pump 40-60 barrels per minute of slurry and large total proppant volumes, often exceeding 1 million pounds. The velocity of the proppant slurry leaving the slurry flow port, coupled with the larger flow volumes, causes erosion and ultimate failure of the wear sleeve and production assembly adjacent the flow port.

The present invention addresses the problems of the prior art.

SUMMARY OF THE INVENTION

The invention provides an improved system for use in gravel packing operations wherein solid materials, in slurry form, are flowed out of the flowbore of a working tool, into the production assembly, and then into the annulus of a wellbore. In preferred embodiments, a gravel packing placement system includes an extension sleeve that is landed in a wellbore and a service tool that is run inside the extension sleeve. The service tool contains a gravel placement mandrel that defines an axial flowbore along its length and two or more lateral slurry flow ports for communication of slurry from the flowbore to the interior of the wear sleeve/blast liner. The slurry flow ports are oriented so as to distribute the slurry in different outwardly radial directions. This helps improve the radial distribution of slurry into the entire surrounding annulus. In addition, it reduces erosion of the surrounding blast liner by distributing the erosive forces among different areas of the blast liner. In a currently preferred embodiment, there are two slurry flow ports (an upper and a lower slurry flow port) that are oriented in opposite radial directions from one another (i.e., they are phased 180 degrees apart). The slurry flow ports are also axially displaced from one another along the gravel placement mandrel body.

Another aspect of the invention provides for relatively equivalent flow rates or flow amounts through each of the slurry flow ports. In one embodiment, a hydraulic choke, in the form of a restriction throat is located within the flowbore of the gravel placement mandrel between the upper and lower slurry flow ports. The restriction throat helps to offset the natural tendency of pumped down slurry to primarily exit the lower slurry flow port by limiting the flow rate to the lower port and creating a high pressure zone that will urge the slurry toward the upper flow port. In an alternative embodiment, the lower port of the gravel placement mandrel has a smaller diameter opening than the upper port, thereby balancing the flow rate toward the upper port to provide for substantially equivalent flow rates between the two flow ports. Because erosion is a function of the square of the fluid velocity when sub-sonic, and up to the fourth power when super-sonic, a reduction of the flow velocity at any given flow port will greatly reduce erosional effects.

In yet another aspect of the present invention, improvements are provided in the geometry of the slurry flow ports to enhance the flow of slurry through them. In a preferred embodiment, the slurry flow ports are generally rectangular in shape and each provides a outwardly and downwardly oriented upper and lower surfaces to help direct the flow of slurry downwardly. The upper slurry flow port also includes an upper enlargement, or recess, which, during operation, provides a low pressure zone that helps to induce flow through the upper flow port.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1A:
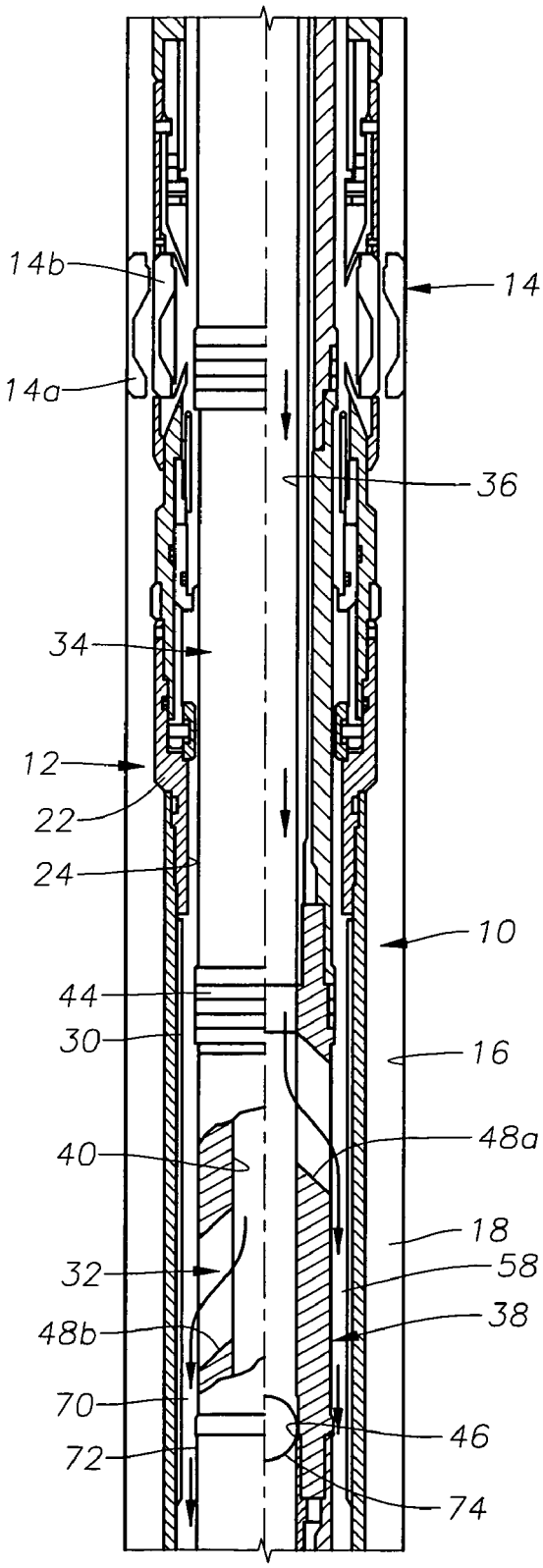
FIGS. 1*a* and 1*b* are side, cross-sectional views of a wellbore having an exemplary solids placement system suspended therein.
Figure 1B:
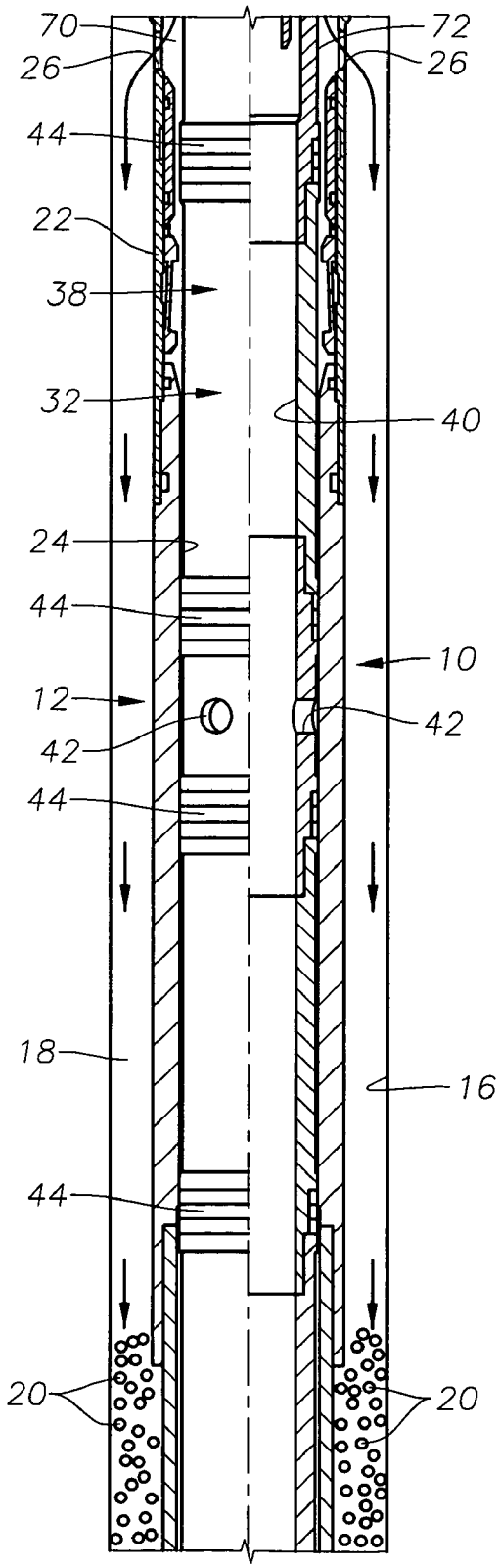

FIGS. 1*a* and 1*b* depict an exemplary solids placement system 10, which includes an extension sleeve assembly 12 that is secured to the lower end of a packer assembly 14. The packer assembly 14 is shown schematically in a set position at 14*a* and in an unset position at 14*b*. The exemplary solids placement system 10 is a system for the placement of gravel within a wellbore 16 during gravel packing. However, those of skill in the art will appreciate that a similar arrangement may be used for disposal of proppants and other solids within a wellbore. It is noted that the details of gravel packing and proppant placement operations generally are well known to those of skill in the art and, therefore, will not be described in detail herein. However, the general outline of an exemplary gravel packing tool and system 10 is described in order to illustrate the present invention.

The packer assembly 14 is a through-tubing packer assembly in that, once set, it can permit a service tool to be passed through its axial center. At the beginning of a gravel packing operation, the packer assembly 14 and extension sleeve assembly 12 are run into the wellbore 16. The packer assembly 14 is set against the cased side of the wellbore 16, and an annulus 18 is thereby defined between the extension sleeve assembly 12 and the side of the wellbore 16. In this situation, it is desired to place gravel 20 within the annulus 18 below the packer 14.

The extension sleeve assembly 12 has a generally cylindrical body 22 and defines an interior bore 24 with a plurality of gravel exit ports 26 disposed therethrough. The gravel exit ports 26 are disposed in an evenly spaced relation around the circumference of the body 22. The extension sleeve assembly 12 also includes a wear sleeve or blast liner 30.

The solids placement system 10 also includes a service tool, generally shown at 32, which is disposed through the packer assembly 14 and into the bore 24 of the extension sleeve assembly 12. The service tool 32 is suspended upon a tubing string 34 that extends to the surface of the wellbore 16. The tubing string 34 defines a central axis 35 and an axial flowbore 36 along its length. The other portion of the service tool 32 is a gravel placement mandrel 38, which is secured to the lower end of the tubing string 34 and defines an axial, interior flowbore 40 along its length as well. Reverse recirculation ports 42 are disposed through a lower portion of the gravel placement mandrel 38. The use of such recirculation ports in gravel packing tools is well understood by those of skill in the art and, therefore, will not be described in any detail herein. Annular elastomeric seals 44 surround the gravel placement tool 38 at intervals along its length and serve to provide fluid sealing. The flowbore 40 of the gravel placement mandrel 38 contains a ball seat 46, which may be formed by the interconnection of the mandrel 38 with another tubular member at its lower end.

Figure 2:
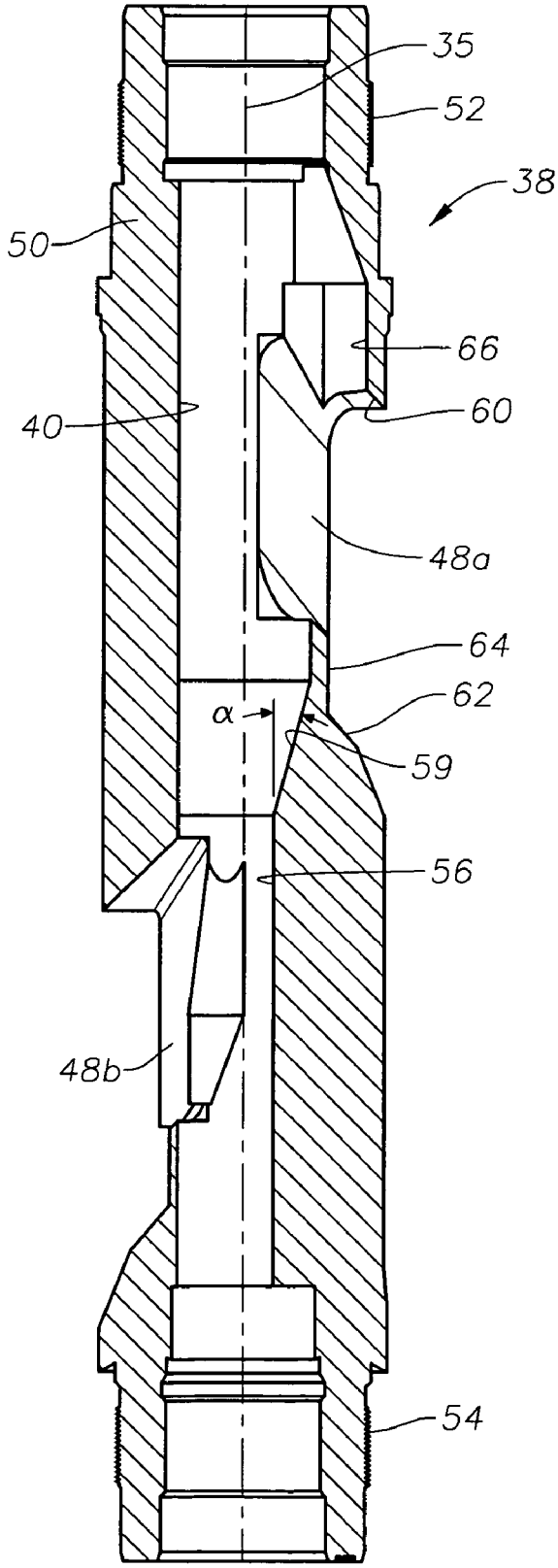
FIG. 2 is a side, cross-sectional view of an exemplary gravel placement mandrel used within the solids placement system shown in FIGS. 1*a* and 1*b*.
Figure 3:
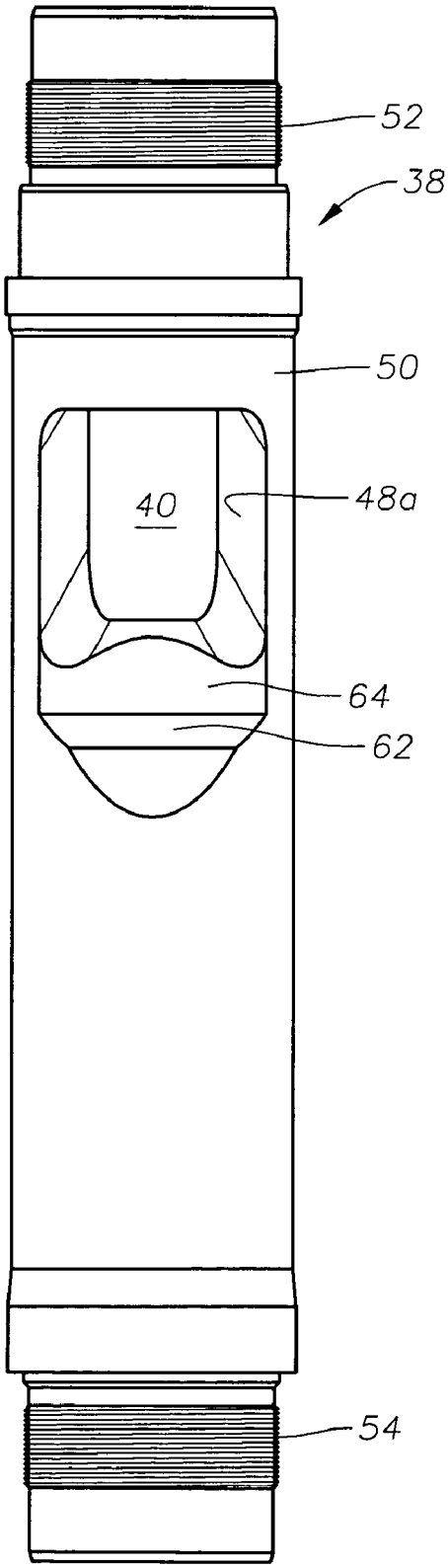
FIG. 3 is an external side view of the gravel placement mandrel shown in FIG. 2.
Figure 5:
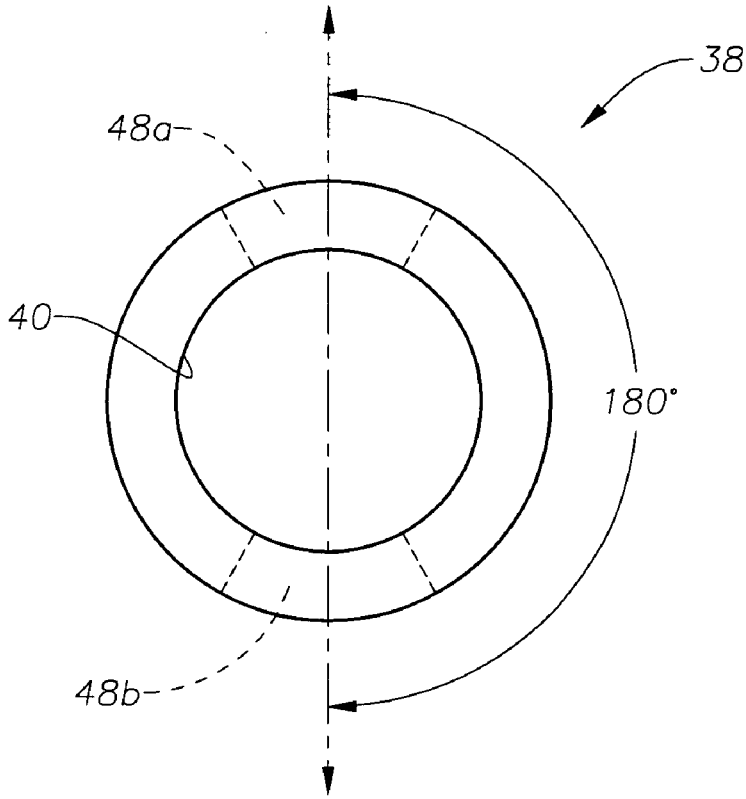
FIG. 5 is a schematic cross-sectional end view of the gravel placement mandrel shown in FIGS. 2 and 3 illustrating the radial orientation of ports.

The structure and operation of the exemplary gravel placement mandrel 38 is better understood with further reference to FIGS. 2, 3 and 5, which depict the gravel placement mandrel 38 apart from the other components of the solids placement system 10. The gravel placement mandrel 38 includes a tubular body 50 with an upper lateral gravel slurry flow port 48*a* and a lower lateral gravel slurry flow port 48*b* disposed therethrough. The upper and lower slurry flow ports are located on diametrically opposed sides of the mandrel body 50 (i.e., they are phased at 180 degrees apart from one another) as illustrated in the end view of FIG. 5. The mandrel body 50 has upper and lower threaded ends 52, 54 for interconnection with adjoining tubular members in the service tool 32.

Referring again to FIGS. 1*a* and 1*b*, when the service tool 32 is disposed into the extension sleeve assembly 12, it is landed by the interengagement of landing shoulders (not shown), in a manner known in the art. When landed, an annular space 70 is defined between the blast liner 30 and the outer radial surface 72 of the gravel placement tool 38. In order to begin placing gravel, a ball plug 74 is dropped into the flowbore 36 of the tubing string 34 and lands upon the ball seat 46. Once the ball plug 74 is seated, any fluids or slurries that are pumped down the flowbore 36 from the surface will be forced to exit the flowbore 36 through the gravel flow ports 48*a* and 48*b*.

The inventor has recognized that, with a flowbore 40 having an unitary diameter along its length, the majority of pumped down slurry will tend to bypass the upper slurry flow port 48*a* and exit the mandrel body 50 via the lower flow port 48*b*. In fact, however, it is desirable to have slurry entering the gravel placement mandrel 38 exit the two flow ports 48*a*, 48*b* in relatively equivalent amounts, as this will reduce the amount of erosion and wear that is created at a single point on the inside of the surrounding blast liner 30. In addition, the gravel slurry will be more evenly distributed within the annular space 58 between the mandrel body 50 and surrounding blast liner 30, and thereby tend to be distributed relatively evenly by the gravel exit ports 26 into the entire surrounding annulus 18. For these reasons, a hydraulic choke in the form of a restriction throat 56 is disposed within the flowbore 40. Generally, the restriction throat will have a diameter that is between about 60% to about 85% of the diameter of the flowbore 40. In a currently preferred embodiment, the restriction throat 56 has a diameter that is approximately three-quarters (75%) the diameter of the flowbore 40. While a restriction of approximately three-quarters is currently preferred, those of skill in the art will recognize that the optimum amount of restriction may vary depending upon flow rate, tool sizes, or other factors. As a result, the optimal amount of restriction in a given instance may be greater than or less than three-quarters of the diameter of the flowbore 40. The restriction throat 56 limits the amount of slurry that can flow downward to the lower port 48*b* and creates an area of high pressure within the flowbore 40 that urges the slurry of gravel toward the upper flow port 48*a*. Thus, the restriction throat 56 results in a greater amount of slurry flow through the upper flow port 48*a* than would occur with an unrestricted flowbore 40 and will result in a substantially equivalent rate of flow through each.

The inventor has recognized that physical restrictions, such as the restriction throat 56, are prone to the same erosive effects as other components within the solids placement tool 10 and will, thereby, tend to erode away over time, allowing slurry flow to be overbalanced toward the lower slurry flow port 48*b*. Thus, in one embodiment, the restriction throat 56 is formed of tungsten carbide, ceramic or another highly erosion-resistant material in order to reduce the rate at which it will be eroded away during operation by the highly abrasive solid particles in the slurry. The restriction throat 56 would also be formed to have a long, gentle slope 59 to help resist erosion. In a currently preferred embodiment, the restriction throat 56 has an upper tapered surface 59 that preferably extends radially inwardly at an angle a that is preferably about 15 degrees.

In another embodiment, the restriction throat 56 is formed to be narrower than desired at the outset to overbalance slurry flow to the upper port 48*a*. As slurry is flowed, the restriction will erode away, thereby increasing flow to the lower port 48*b*. For example, during the initial stages of operation, the slurry flow might be overbalanced toward the upper flow port 48*a* in a ratio of about 70% to 30% exiting the lower flow port 48*b*, due to the narrowness of the restriction throat 56. Later in the operation, as the throat 56 becomes enlarged due to erosion, the proportional flow rate may become overbalanced to the lower port 48*b* (for example 70% flow through the lower port 48*b* and 30% to the upper port 48*a*). As a result, the flow rates become substantially balanced over time.

The upper and lower gravel slurry flow ports 48*a*, 48*b* are also preferably shaped and sized to accommodate high rates of slurry flow while minimizing erosion damage to the mandrel body 50. The upper slurry flow port 48*a* has generally rectangular in shape, as is best appreciated with reference to FIG. 3. Beginning at the outer radial surface of the mandrel body 50, the upper flow port 48*a* slopes inwardly and upwardly due to angled upper and lower surfaces 60, 62. The lower angled face 62 then transitions into a substantially vertical face 64. The upper angled surface 60 transitions into an outwardly enlarged upper recess 66. The recess 66 is effective in drawing slurry into the upper slurry flow port 48*a* because it creates an area of low pressure during pumping of slurry. The lower slurry flow port 48*b* is also substantially rectangular in shape and is formed otherwise similarly to the upper port 48*a*. However, the lower port 48*b* is not provided with an upper recess 66.

Figure 4:
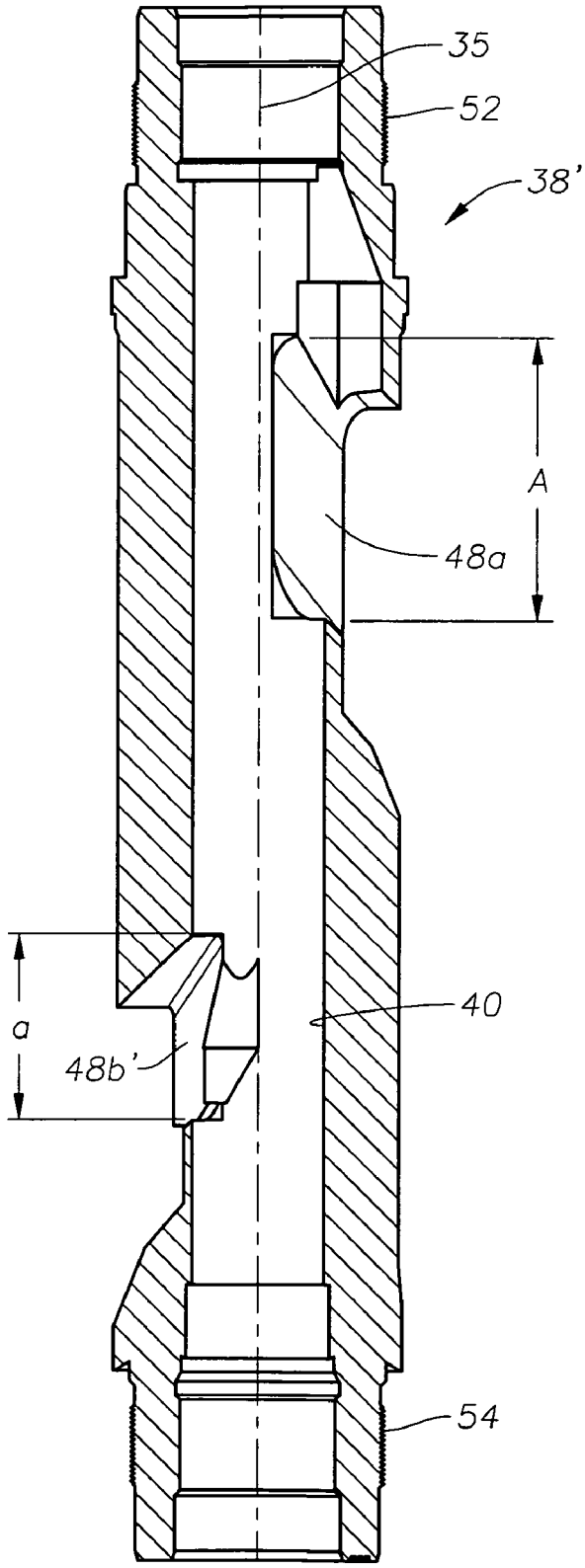
FIG. 4 is a side, cross-sectional view of an alternative gravel placement mandrel that may be used within the solids placement system shown in FIGS. 1*a* and 1*b*.

FIG. 4 depicts an alternative construction for a gravel placement mandrel that is designated 38'. In this embodiment, there is no restriction throat located in the flowbore 40. However, the lower slurry flow port 48*b*' has an opening area that is less than the opening area (A) of the upper flow port 48*a*. In a currently preferred embodiment, the lower port 48*b*' has an opening area (a) that is approximately 70% of the opening area of the upper port 48*a*. The reduced size of the lower port 48*b*' results in reduced flow rate through that port and, consequently, an increased flow rate through the upper port 48*a* so that the overall flow rate through both ports 48*a*, 48*b*' is substantially balanced.

Figure 6:
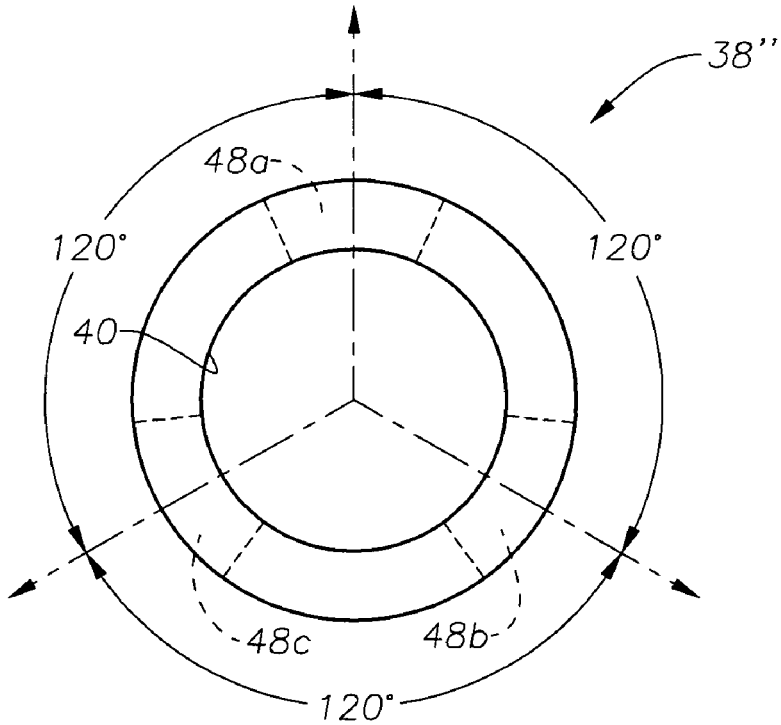
FIG. 6 is a schematic cross-sectional end view of an alternative gravel placement mandrel depicting an exemplary radial orientation of ports.

Although FIGS. 2, 3, 4 and 5 depict gravel placement mandrels with two slurry flow ports 48*a*, 48*b*, there may in fact, be more than two such ports. In that instance, the slurry flow ports should be spaced equidistantly around the circumference in addition to being axially displaced from one another. FIG. 6 depicts an exemplary gravel placement mandrel 38" with three slurry flow ports 48*a*, 48*b*, and 48*c*. In this embodiment, the slurry ports are directed radially outwardly to distribute slurry in radial directions that are separated from each other by about 120 degrees. Additionally, each of the ports 48*a*, 48*b*, 48*c* are axially displaced from one another along the body of the mandrel 38". Port 48*a* is the uppermost port on the mandrel 38", while port 48*b* is the middle port, and port 48*c* is the lowermost port. Restriction throats similar to throat 56 are located between each of the ports 48*a*, 48*b*, 48*c* to encourage increased flow through the upper ports 48*a*, 48*b*. Alternatively, the lower ports 48*b*, 48*c* are sized to promote greater proportionate flow through the upper ports, as described previously.

Those of skill in the art will understand that the principles described above may be extended to four or a greater number of ports to assist in improved distribution of slurry into the annular space 70 and then into the annulus 18. For example, a mandrel with four ports might have the ports oriented with 90 degree separation between them. Separating the ports axially along the body of the mandrels 38, 38', 38" is desirable because it helps to preserve the tensile strength and integrity of the mandrel during operation. The slurry ports 48*a*, 48*b*, 48*c* are relatively wide and their presence within the mandrel removes a substantial portion of the mandrel body structure. If multiple ports were disposed at the same axial level on the body of the mandrel, the mandrel body structure could be significantly weakened.

In operation, flow of gravel slurry out of the slurry flow ports 48*a* and 48*b* (or 48*a*, 48*b*, and 48*c*) and through the annular space 70 to the gravel flow ports 26 will result in gravel being distributed relatively evenly within the annular space 70 about the entire circumference of the gravel placement tool 38. In addition, the use of multiple gravel slurry flow ports 48*a* and 48*b* will prevent a single small area of the blast liner 30 from receiving all of the erosive force of slurry that would occur if a single slurry flow port were used instead.

Those of skill in the art will recognize that the above-described devices and methods, although described in relation to a gravel packing arrangement, are also readily applicable to other solids placement arrangements, such as fracturing tools that place solid proppants within a wellbore. Those of skill in the art will also recognize that numerous modifications and changes may be made to the exemplary designs and embodiments described herein and that the invention is limited only by the claims that follow and any equivalents thereof.

What is claimed is:

1. A gravel placement mandrel for use in a solids placement tool within a wellbore, the gravel placement mandrel comprising:

a mandrel body having upper and lower axial ends and defining an axial flowbore therethrough, the flowbore having a diameter;

a first lateral slurry flow port disposed through the mandrel body;

a second lateral slurry flow port disposed through the mandrel body and axially offset below the first lateral slurry port on the mandrel body;

wherein the first lateral slurry flow port further comprises a radially enlarged recess proximate the flowbore to create a low pressure zone proximate the first flow port and thereby increase fluid flow rate therethrough;

wherein the second lateral slurry flow port does not have a radially enlarged recess proximate the flowbore; and a flowbore closure member that is seated within the flowbore prior to flowing slurry through the flowbore and flow ports.

2. The gravel placement mandrel of claim 1 wherein the first and second flow ports are oriented to flow slurry from the flowbore in different radial directions.

3. The gravel placement mandrel of claim 1 wherein the first flow port is oriented to flow slurry radially outwardly in a first radial direction and the second flow port is oriented to flow slurry radially outwardly in a second radial direction that is about 180 degrees apart from the first direction.

4. The gravel placement mandrel of claim 1 further comprising a restriction throat disposed within the flowbore of the mandrel to cause increased slurry flow through the first slurry flow port.

5. The gravel placement mandrel of claim 4 wherein the restriction throat has a diameter that is between about 60% to about 85% of the diameter of the flowbore.

6. The gravel placement mandrel of claim 1 wherein the first lateral slurry port has an opening area and the second lateral slurry flow port has a second opening area that is less than the first opening area.

7. The gravel placement mandrel of claim 1 further comprising a third lateral slurry flow port and wherein the first, second and third lateral slurry flow ports are oriented to flow slurry in outwardly radial directions that are separated by approximately 120 degrees.

8. The gravel placement mandrel of claim 7 further comprising a restriction throat disposed within the flowbore of the mandrel between each of the flow ports to cause increased slurry flow through the first and second slurry flow ports.

9. The gravel placement mandrel of claim 7 wherein the second and third slurry flow ports have progressively smaller opening areas than the first slurry flow port.

10. A gravel placement mandrel for use in a solids placement tool within a wellbore, the gravel placement mandrel comprising:

a mandrel body having upper and lower axial ends and defining an axial flowbore therethrough, the flowbore having a diameter;

a first lateral slurry flow port disposed through the mandrel body;

a second lateral slurry flow port disposed through the mandrel body and axially offset below the first lateral slurry port on the mandrel body;

a third lateral slurry flow port disposed through the mandrel body;

a restriction throat disposed within the flowbore between each of the flow ports to cause increased slurry flow through the first and second slurry flow ports; and a flowbore closure member that is seated within the flowbore prior to flowing slurry through the flowbore and flow ports.

11. The gravel placement mandrel of claim 10 wherein the first, second and third lateral slurry flow ports are oriented to flow slurry in outwardly radial directions that are separated by approximately 120 degrees.

12. The gravel placement mandrel of claim 11 wherein the second and third slurry flow ports have progressively smaller opening areas than the first slurry flow port.

* * * * *